US008306449B2

(12) United States Patent
Stresau

(10) Patent No.: US 8,306,449 B2
(45) Date of Patent: Nov. 6, 2012

(54) ROLLER TO AFFECT THE TEMPERATURE OF A PRINT SUBSTRATE IN A DIGITAL PRINTER

(75) Inventor: Juergen Stresau, Moosinning (DE)

(73) Assignee: Océ Printing Systems GmbH, Poing (DE)

( * ) Notice: Subject to any disclaimer, the term of this patent is extended or adjusted under 35 U.S.C. 154(b) by 288 days.

(21) Appl. No.: 12/703,390

(22) Filed: Feb. 10, 2010

(65) Prior Publication Data

US 2010/0209133 A1 Aug. 19, 2010

(30) Foreign Application Priority Data

Feb. 17, 2009 (DE) ..... 10 2009 009 297

(51) Int. Cl.
*G03G 21/20* (2006.01)

(52) U.S. Cl. ..... 399/94; 132/245; 219/470; 219/216; 432/60; 399/92; 399/322; 399/328

(58) Field of Classification Search ..... None
See application file for complete search history.

(56) References Cited

U.S. PATENT DOCUMENTS 688,912 A * 12/1901 Watts ..... 198/311
3,260,267 A * 7/1966 Rubenstein et al. ..... 132/245
4,127,764 A 11/1978 Minden
4,959,693 A 9/1990 Mitsuya et al.
5,094,613 A * 3/1992 Dolcimascolo et al. ..... 432/60
5,241,159 A * 8/1993 Chatteriee et al. ..... 219/470
5,557,388 A 9/1996 Creutzmann et al.
5,805,969 A 9/1998 Elsermans et al.
6,246,856 B1 6/2001 Kopp et al.
6,567,629 B2 5/2003 Anderson et al.
6,907,220 B2 6/2005 Mitsuya et al.
2008/0122916 A1 * 5/2008 Marsh et al. ..... 347/112
2008/0267651 A1 10/2008 Gruszczynski et al.

FOREIGN PATENT DOCUMENTS

| | | |
|---|---|---|
| DE | 38 38 021 | 6/1989 |
| DE | 42 35 667 | 1/1994 |
| DE | 201 19 854 | 4/2002 |
| DE | 102 27 953 | 1/2004 |
| EP | 0758 766 | 5/2001 |
| WO | WO 98/39691 | 9/1998 |

* cited by examiner

*Primary Examiner* — Matthew Luu
*Assistant Examiner* — John P Zimmermann
(74) *Attorney, Agent, or Firm* — Schiff Hardin LLP

(57) ABSTRACT

In a roller to affect a temperature of a print substrate in a digital printer, a hollow roll is mounted to a shaft. Channels are provided for a heat transport medium in the hollow wall. A roller shell of the hollow roll is comprised of arc-shaped segments extending over a width of the hollow roll. The segments end laterally in arms designed so that the arms of adjacent segments are connected to each other. The channels extend over the width of the hollow roll and are assembled respectively from the segments of the roller shell. A respective covering plate is clamped between the arms of the respective segments.

11 Claims, 6 Drawing Sheets

ROLLER TO AFFECT THE TEMPERATURE OF A PRINT SUBSTRATE IN A DIGITAL PRINTER

BACKGROUND

Electrographic digital printers are known, see, for example, WO 98/39691 A1 (=U.S. Pat. No. 6,246,856 A). In such a printing device or copying machine, charge images of the images to be printed are produced on a charge image carrier, for example, a photoreceptor belt, by means of a character generator. Subsequently, the charge image carrier is moved past developer stations, one for each color. These developer stations transport developers consisting, for example, of a toner and a carrier, to the charge image carrier. In accordance with the charge images on the charge image carrier, the toner passes over to the charge image carrier and stains the charge images. In the next step, the toner images are reprinted onto a print substrate and fused with the print substrate. The precise method of the printing process is described in WO 98/39691 A1, the content of which is thus included in the disclosure.

Usually, thermosetting is used to fuse the toner images with the print substrate. For this purpose, for example, fusing rollers are used with at least one of them being heated. Also infrared radiators are used as a heat source. Thermosetting of the toner images on the print substrate involves that the print substrate still has a temperature of, for example, 120° C. or higher upon leaving the fuser station, which makes further processing of the print substrate difficult. In order to eliminate this disadvantage, it is known to cool the print substrate after it leaves the fuser station.

According to DE 42 35 667 C1 (=U.S. Pat. No. 5,557, 388A), cooling air is blown on the print substrate in order to cool the print substrate. The cooling device used for this purpose comprises cooling surfaces equipped with openings. Via an air duct, cold air is supplied to the openings. The air flows from the openings under the print substrate where it forms a cooling air cushion. At the same time, air is blown onto the other surface of the print substrate, namely against the direction of travel of the print substrate.

Further cooling units are known, for example, from DE 38 38 021 C2 (=U.S. Pat. No. 4,959,693A), EP 0 758 766 B1 (=U.S. Pat. No. 5,805,969), DE 201 19 854 U1, U.S. Pat. Nos. 6,907,220 B2, 6,567,629 B2. There, for example, fans are used to cool a print substrate or rollers which are cooled from outside or inside.

Rollers can be produced, for example, from aluminum in an extrusion process. For this purpose, the rollers, for example, cooling rolls, should have a diameter of >250 mm, for example, 400 mm. If, during the production of such a roll in an extrusion process, the material is pressed through the die (pressing tool), and produces the pipe of the roll with this diameter, the pipe leaves the die in a warm condition and is not yet inherently stable to carry its own weight. Increasing the wall thickness, then, is disadvantageous for heat conduction, because a compact wall thickness constrains heat conduction. Moreover, it is not possible to produce thin fins, for example, cooling fins, since the fins cannot be additionally supported because of the closed shape of the die. However, the fins must be self-supporting and stable in order to accept the forces of the extrusion process. Therefore only thick and only a few fins are used. Since the heat transmission depends on the available surface of the pipe and the fins, the maximum heat flow volume to be transmitted is restricted in the production method described. This disadvantage results, for example, in the fact that in practice, several small rollers or water-cooled rollers are used to cool a print substrate after toner images have been fused. This results in increasing costs for cooling a print substrate, for example, at the start of a fuser station.

SUMMARY

It is an object to solve the problem of providing a roller which can be produced without demonstrating the problems described above. The roller should be suitable to cool or heat a print substrate.

In a roller to affect a temperature of a print substrate in a digital printer, a hollow roll is mounted to a shaft. Channels are provided for a heat transport medium in the hollow wall. A roller shell of the hollow roll is comprised of arc-shaped segments extending over a width of the hollow roll. The segments end laterally in arms designed so that the arms of adjacent segments are connected to each other. The channels extend over the width of the hollow roll and are assembled respectively from the segments of the roller shell. A respective covering plate is clamped between the arms of the respective segments.

DESCRIPTION OF THE PREFERRED EMBODIMENT

Figure 1:
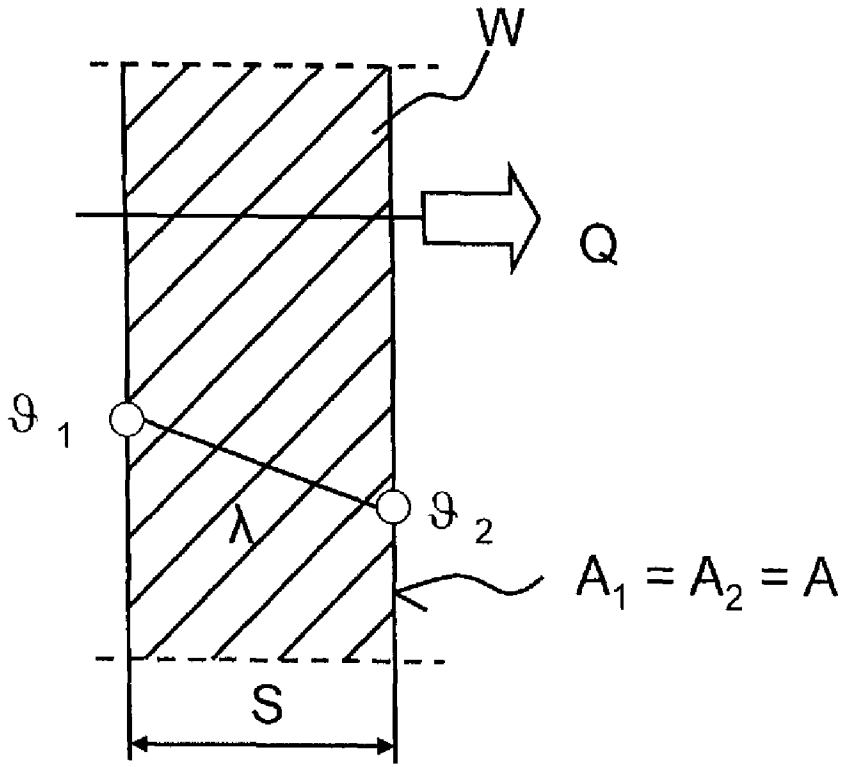
FIG. 1 is a block diagram which shows the heat transport through a wall.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The roller of the preferred embodiment comprises a hollow roll mounted on a shaft. In the hollow roll shaft channels have been arranged through which a medium can be transported which medium has an effect on the temperature of the hollow roll. Subsequently, said medium shall be called a heat transport medium. This heat transport medium can be comprised of, for example, cooling air or heated air.

The roller shell (the pipe) of the hollow roil is designed of arc-shaped segments which extend over the width of the roller. The segments end laterally in arms. The arms are constructed in such a way that the arms of adjacent segments can be completely connected with each other. The channels extend over the width of the hollow roll, each being constructed from the segments of the roller shaft and the covering plates clamped between the arms of the respective segment. This structure has the advantage that only the segments have to be produced in an extrusion process and not a complete roller shell or a pipe.

Consequently, a channel can be designed in such a way that the arms of the respective segment comprise a bar which extends over the width of each segment and clamped to each bar is the covering plate.

The sides of the arms can be designed in such a way that the arms of adjacent segments can be connected through a tongue and groove system. As a result, it is easy to form a connection between the segments and the roller shell of the hollow roll.

The open ends on both sides of the hollow roll can be closed with a respective lateral flange which is mounted on the shaft. It is easy to attach the lateral flanges to the arms of the segments in that screws set in the lateral flanges are screwed into the screw channels of the arms. For this purpose, self-cutting screws can be used.

In order to be able to supply the roller from inside with a heat transport medium, for example, cooled air, the lateral flanges can be designed in such a way that they do not cover the channels.

The heat transport effect can be increased in that the segments comprise fins protruding into the hollow roll.

A roller designed in such a way can be produced in an easy manner by producing the segments individually in an extrusion process and by mounting the segments to each other until the roller shell of the hollow roll is produced. Subsequently, in order to form the channels, the covering plates are clamped between the arms of the segments. Finally, the open ends of the hollow roll are closed with the lateral flanges. The roller thus produced can be pushed on a shaft and mounted at the usage site. In producing the roller, it is only required to use the extrusion process for the segments. However, the net weight of the segments is not so large that it would cause problems after the pressing process. Consequently, the segments can be produced according to the requirements of heat transport.

The roller of the preferred embodiment can be used in an advantageous manner, for example, as a cooling roll in an electrographic digital printer, to cool the print substrate after the toner images have been fused. The roller is located at the output of the fuser station where it is supplied with cooling air as a heat transport medium.

Moreover, the roller of the preferred embodiment can be used in an advantageous manner in an inkjet digital printer in which the print substrate has to be dried after applying the ink. In this case, the roller can be supplied with heated air as heat transport medium.

Consequently, roller of the preferred embodiment has the following advantages:

- It provides improved heat conduction because with equal heat flow the surface temperature of the internal wall of the roller shell can be higher. This makes the use of air as a heat transport medium more effective.
- It is possible to construct a more delicate fin design. As a result, more fins can be attached to the roller shell which, in turn, increases the surface for the heat transport.
- The production costs of the roller shell can be reduced because the segments are thinner which results in the fact that less material is required for the roller. Also the die for production is smaller and therefore cost-efficient.
- Since the segments have a smaller shape and require lower pressing forces, smaller extrusion machines can be used for production.
- Smaller channels can be designed. This allows for lower volume flow at equal flow velocities. It is possible to use low-energy fans to produce electricity from the heat transport medium.

The preferred embodiment is explained in more detail by means of an embodiment which is shown in the drawing Figures.

FIG. 1 shows a block diagram of a wall W of the width s through which heat is to be transported. The heat transport through the wall corresponds to $$Q=\lambda/s*A(\delta 1-\delta 2)$$

Applying:

Q=heat flow

λ=heat conduction of the wall W s=thickness of the wall

A=surface of the wall (δ1−δ2)=temperature difference

This shows how the heat transport through the wall W depends on its width s. The wider the wall W the smaller the heat transport through the wall W. Transferred to a roller which should cool or heat a print substrate, where the interior of the roller should be supplied with a respective heat transport medium, this means that the width s of the wall W should be kept as small as possible. However, then during the production of the hollow roll pipe in an extrusion process, the above-mentioned problems occur.

Figure 2:
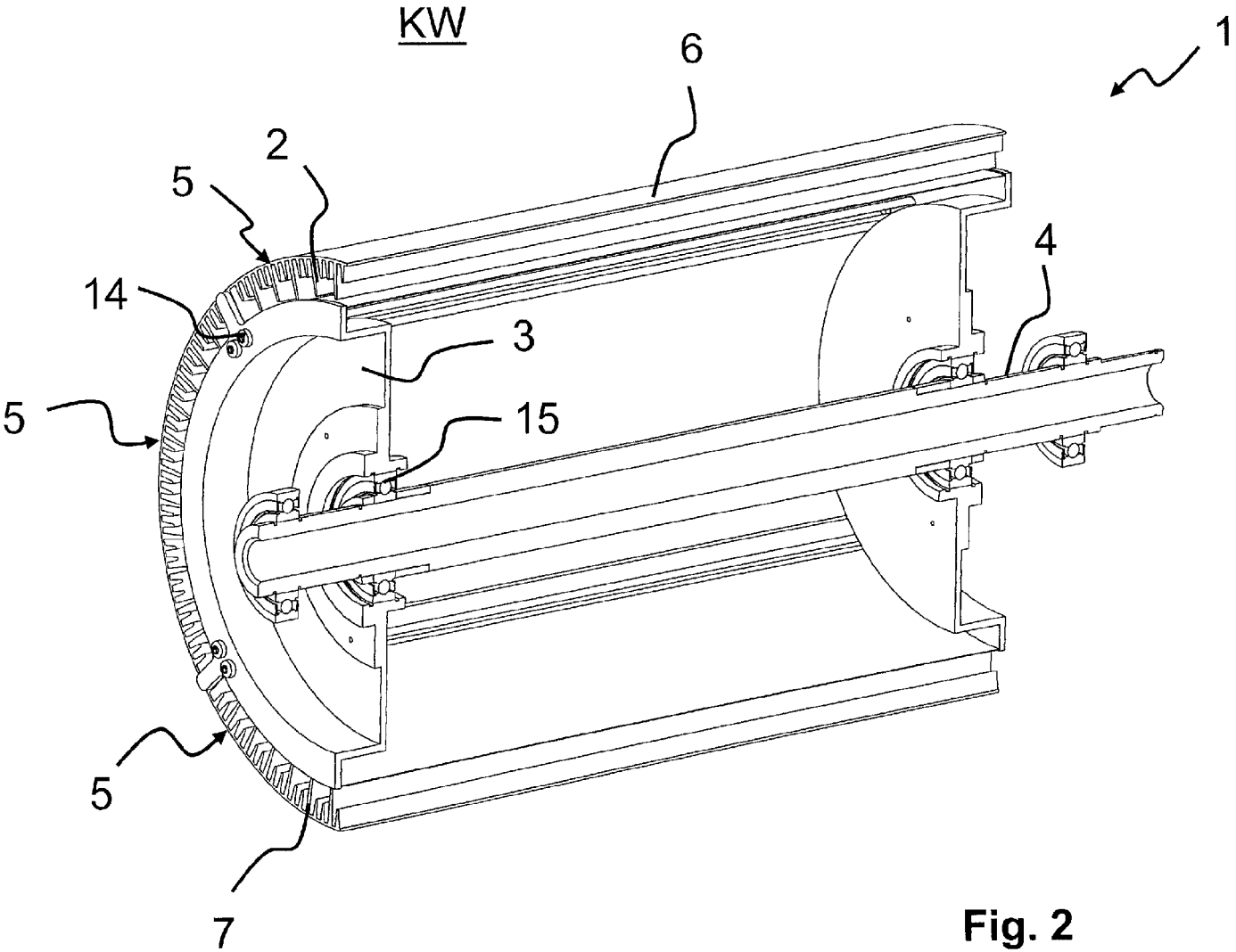
FIG. 2 is a cross section through a roller.
Figure 3:
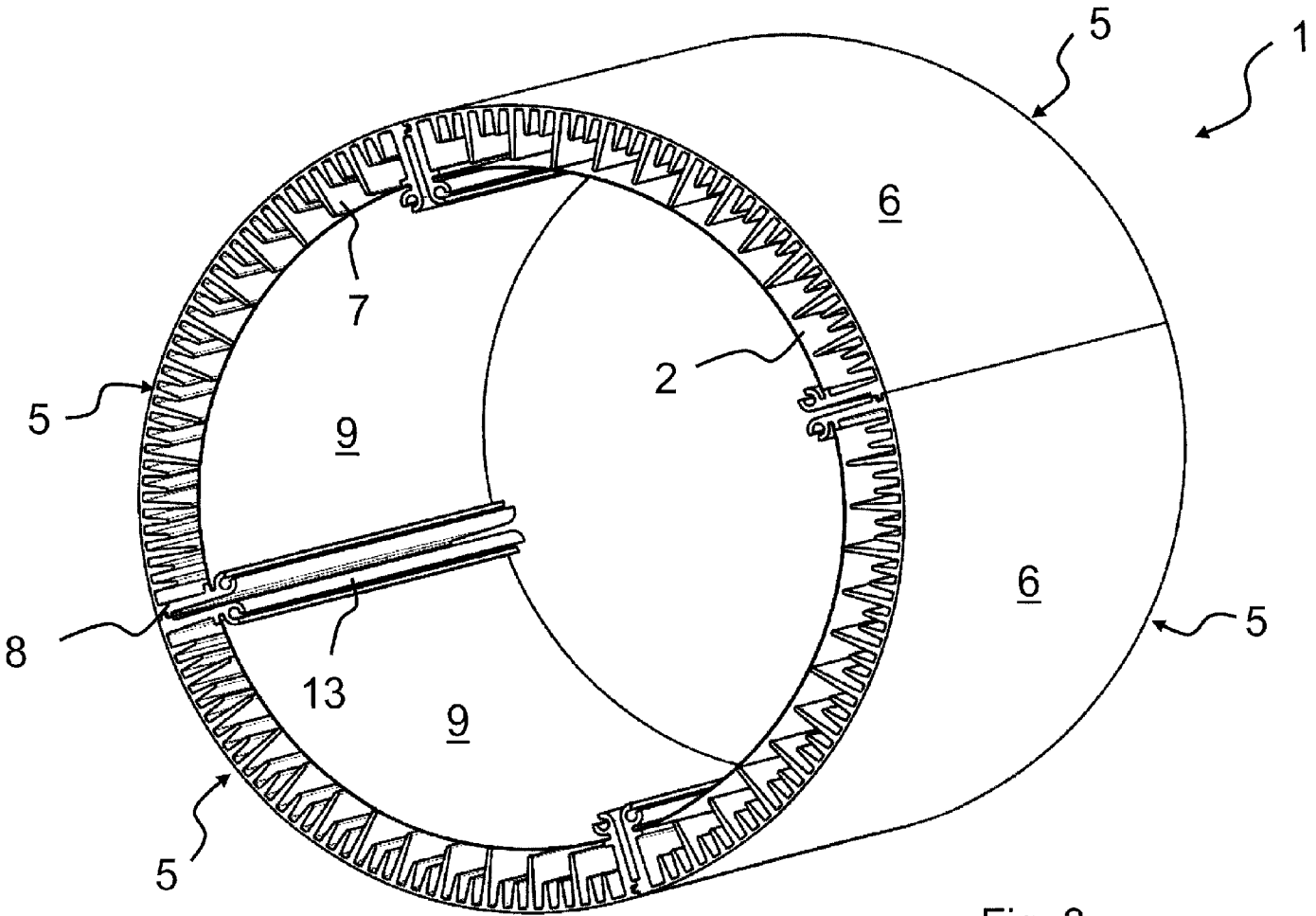
FIG. 3 is a representation of the hollow roll.
Figure 4:
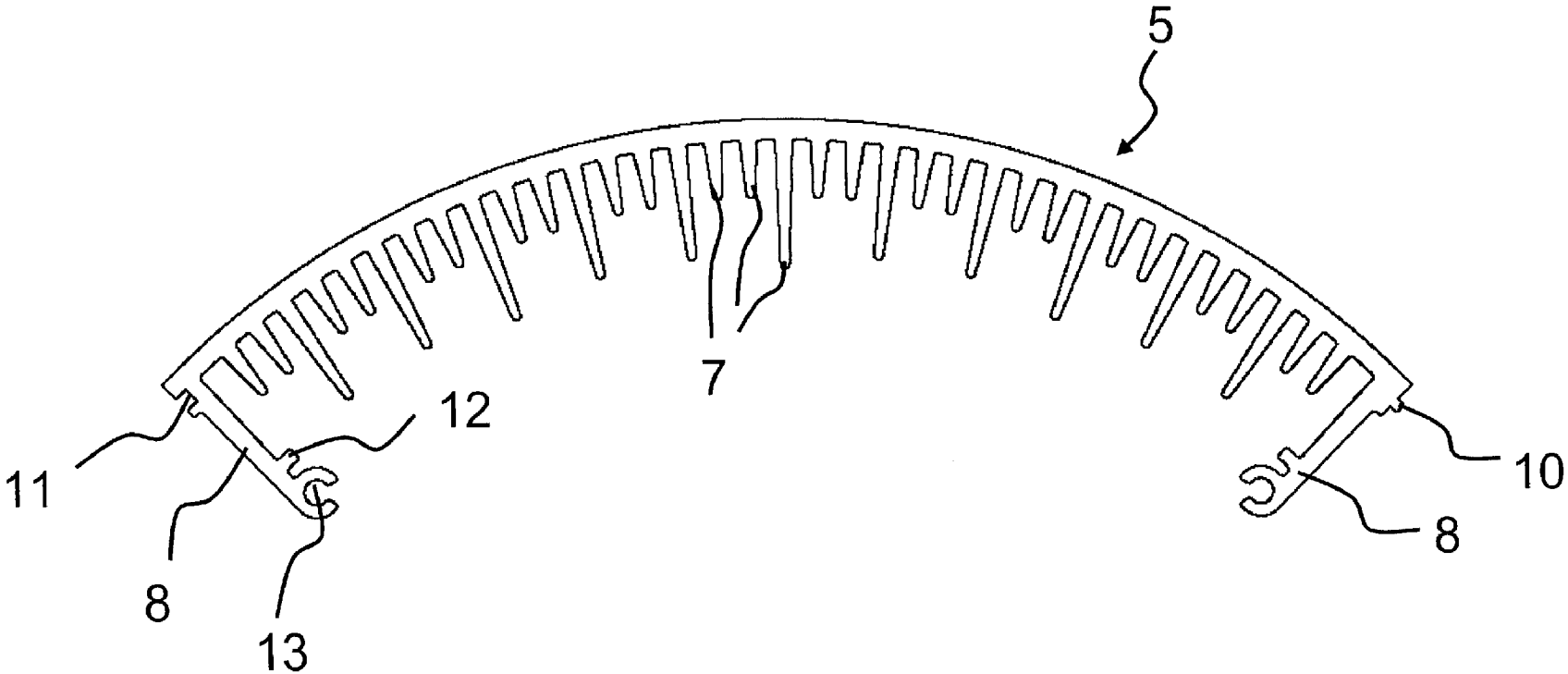
FIG. 4 shows the view of a segment.

FIG. 2 shows a roller designed in accordance with the preferred embodiment and which does not comprise the disadvantages of the prior art. The roller KW is comprised of:

A hollow roll 1 (FIG. 3);

Channels 2 (FIG. 4);

Lateral flanges 3 (FIG. 6); and

A shaft 4 to which the hollow roll 1 is mounted (FIG. 2).

The individual components of the roller KW are explained by means of FIGS. 3 to 6.

The structure of the hollow roll 1 is shown in FIG. 3. It comprises:

- Segments 5 which form the roller shell 6 and which have an arc-shaped design. The roller shell 6 is composed of segments 5, for example, in this case of four segments 5. The segments 5 extend over the width of the hollow roll 1. They are designed in such a way that they can be completely joined to each other. In the embodiment, the segments 5 are provided with fins 7. On both sides, the segments 5 end in, arms 8 which also extend over the width of the hollow roll 1.
- The arms 8 of a segment 5 are designed in such a way that they can be completely connected to the arms 8 of the adjacent segment 5, and they are designed in such a way that the arms 8 of the adjacent segments can be tightly connected (FIG. 5).
- Furthermore, the arms 8 of the segments 5 are designed in such a way that a covering plate 9 can be clamped between the arms 8 of each segment 5. As a result, channels 2 are formed which are comprised of a segment 5 with the arms 8 and the covering plate 9. Consequently, in the embodiment of FIG. 3, four segments 5, each with a channel 2, are provided, whereas each channel 2 can be separately supplied with a heat transport medium.

FIG. 4 shows the structure of a segment 5. One segment 5 forms a respective section of the roller shell 6.

At the segment 5 fins 7 can be arranged which in FIG. 4 are of different length. At both ends of the segment 5 arms 8 are arranged with one arm 8 comprising a pin 10 which interacts with a groove 11 of the adjacent segment 5, and the other arm 8 provides a groove 11 which interacts with a pin 10 of an adjacent segment 5. Furthermore, each arm 8 comprises a bar 12 to which the covering plate 9 can be clamped. Each arm 8 also culminates in a screw channel 13. Screws can be screwed into the screw channels 13, for example, in order to screw the segments 5 to the lateral flanges 3.

Figure 5:
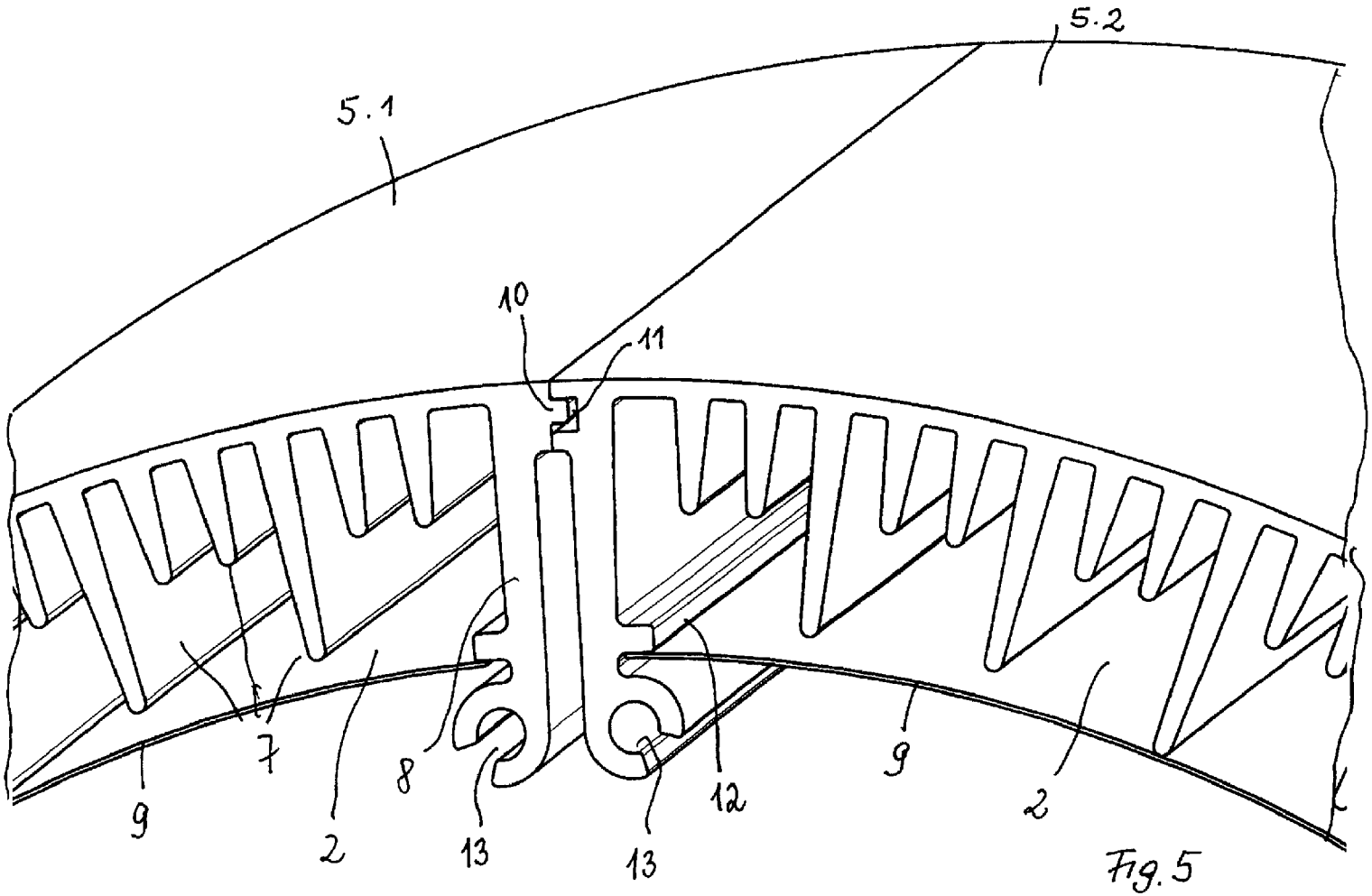
FIG. 5 illustrates the connection of two segments implementing the channels.

FIG. 5 shows how two segments 5.1 and 5.2 can be connected to each other. According to FIG. 5, a tongue and groove system comprised of the tongue 11 of a segment 5 and a pin 10 of the adjacent segment 5 can be used for this purpose. This requires only that the adjacent segments 5.1 and 5.2 are pushed into each other. Furthermore, the covering plate 9 is clamped to the bar 12 in order to form the channel 2. The arms 8 culminate in screw channels 13 into which the screws can be screwed to secure the lateral flanges 3.

Figure 6:
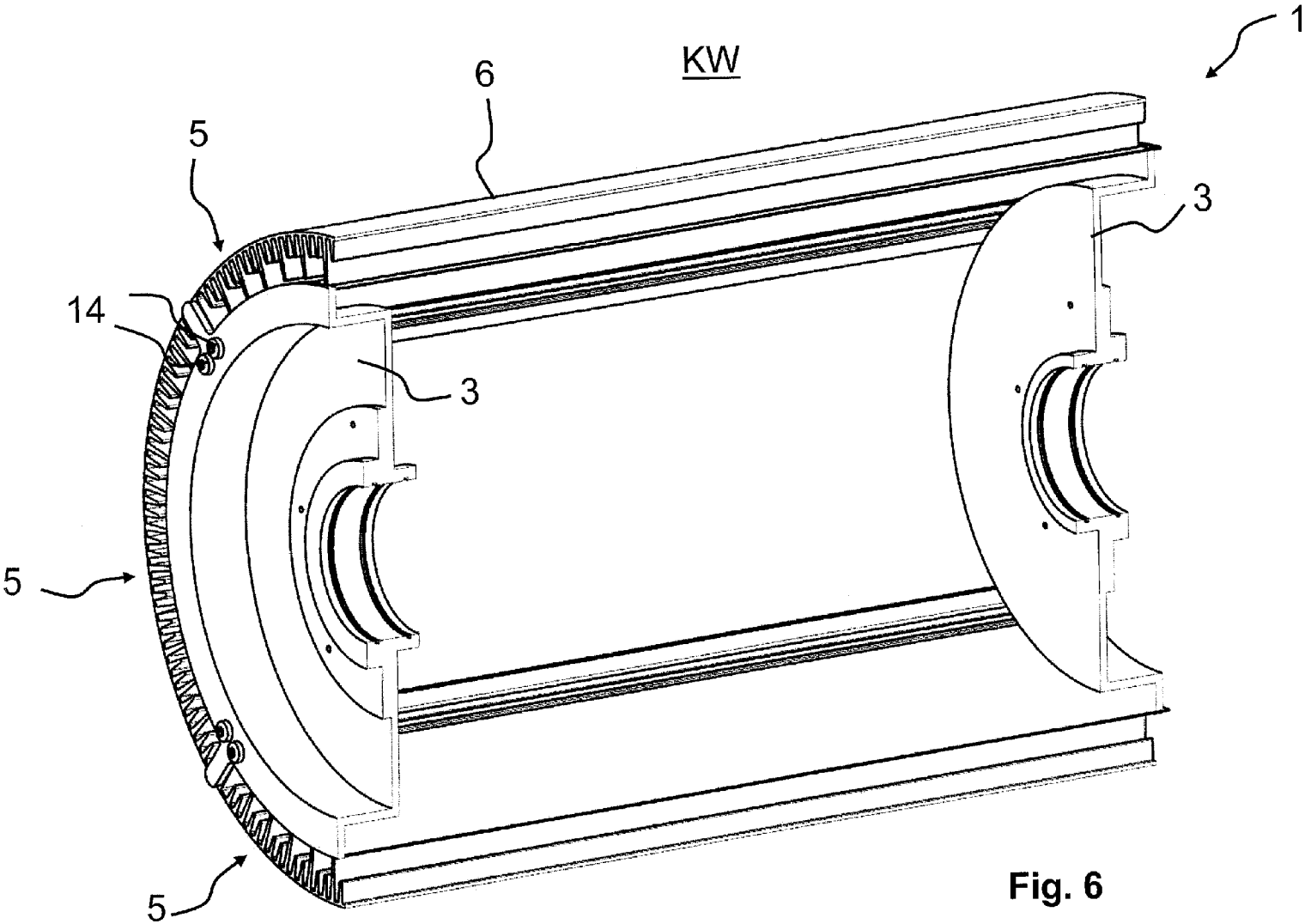
FIG. 6 illustrates the structure of the roller without shaft.

FIG. 6 shows one half of the roller in assembled condition. The hollow roll 1 comprised of segments 5 is laterally closed with lateral flanges 3 which are connected with the arms 8 of the segments 5 by means of screws 14 which are screwed into the screw channels 13. As a result, a roller KW is formed from a hollow roll 1, the segments 5, the covering plates 9 and the lateral flanges 3. The lateral flanges 3 are designed in such a way that they keep the channels 2 free. As a result, a heat transport medium can be guided through the channels 2. As a heat transport medium, for example, ambient air can be used which is blown into the channels 2, for example, through a fan.

FIG. 2 shows a completely assembled roller KW. By means of ball bearing 15, the roller KW is mounted to a shaft 4. FIG. 6 shows the remaining structure of the roller KW.

The production of the roller KW can comprise the following steps:

The segments 5 are produced in an extrusion process;

The segments 5 are assembled to form the roller shell 6;

The covering plates 9 are clamped at the bars 12 of the arms 8 of the segments 5 in order to form the channels 2;

The lateral flanges 3 are screwed to the arms 8;

The hollow roll 1 is pushed onto the shaft 4.

Consequently, only the segments 5 have to be produced by means of the extrusion process. At the same time, the segments 5 can have small dimensions, i.e., they can be produced with a narrow wall thickness. Furthermore, the fins 7 can have a delicate design. Even with small dimensions, the segments 5 can no longer be deformed after leaving the die.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. A roller to affect a temperature of a print substrate in a digital printer, comprising:

a hollow roll mounted to a shaft having a longitudinal axis, and channels having a longitudinal extent running parallel to said axis for a heat transport medium arranged in the hollow roll;

a roller shell of the hollow roll containing said channels and comprised of arc-shaped segments which extend over a width of the hollow roll;

the segments ending laterally in arms, the arms being designed such that the arms of adjacent segments are connected to each other; and the channels extending over the width of the hollow roll and are formed by the segments of the roller shell and a respective covering plate clamped between the arms of the respective segments.

2. The roller according to claim 1 in which the arms of the segments are designed in such a way that the segments are completely connected to form the roller shell.

3. The roller according to claim 2 in which the arms are designed in such a way that the arms of adjacent segments are connected in accordance with a tongue and groove system.

4. The roller according to claim 1 in which the hollow roll is closed on both sides by a respective lateral flange.

5. The roller according to claim 4 in which the arms comprise screw channels in which each of the lateral flanges is connected with the arms by means of screws screwed into the screw channels.

6. The roller according to claim 5 in which the connection is made by means of self-cutting screws.

7. The roller according to claim 4 in which the lateral flanges are designed in such a way that they do not cover the channels.

8. The roller according to claim 1 in which the segments comprise fins which protrude into the hollow roll.

9. The roller according to claim 1 in which the arms of the respective segment each comprise over a width of the segment a bar against which a respective end of the respective covering plate abuts.

10. The roller according to claim 1 in which the segments are produced in accordance with an extrusion process.

11. A roller to affect a temperature of a print substrate in a digital printer, comprising:

a hollow roll mounted to a shaft having a longitudinal axis and channels having a longitudinal extent running parallel to said axis for a heat transport medium arranged in the hollow roll;

a roller shell of the hollow roll containing said channels spaced radially outwardly of said shaft and comprised of arc-shaped segments which extend over a width of the hollow roll, a hollow space being defined between said roller shell and said shaft;

the segments ending laterally in arms, the arms being designed such that the arms of adjacent segments are connected to each other;

the channels extending over the width of the hollow roll and are formed by the segments of the roller shell and a respective covering plate clamped between the arms of the respective segments; and the arms of the adjacent segments being connected to one another via a respective lateral flange at opposite open ends of the hollow roll with respective engagement elements interacting with the respective flange and the arms of the adjacent segments.

* * * * *